US009121167B2

(12) United States Patent
Carbaugh et al.

(10) Patent No.: US 9,121,167 B2
(45) Date of Patent: Sep. 1, 2015

(54) ADJUSTABLE FRAME CONNECTOR

(71) Applicants: Michael A. Carbaugh, Marcola, OR (US); Alroy C. Stevens, Springfield, OR (US)

(72) Inventors: Michael A. Carbaugh, Marcola, OR (US); Alroy C. Stevens, Springfield, OR (US)

( * ) Notice: Subject to any disclaimer, the term of this patent is extended or adjusted under 35 U.S.C. 154(b) by 17 days.

(21) Appl. No.: 14/082,741

(22) Filed: Nov. 18, 2013

(65) Prior Publication Data

US 2015/0136191 A1 May 21, 2015

(51) Int. Cl.
*E04H 15/34* (2006.01)
*E04B 1/344* (2006.01)
*E04H 15/44* (2006.01)

(52) U.S. Cl.
CPC ..... *E04B 1/3441* (2013.01); *E04H 15/34* (2013.01); *E04H 15/44* (2013.01)

(58) Field of Classification Search
CPC ..... E04H 15/34; E04H 15/44; E04H 15/48; E04B 1/3441; E04F 11/1834; Y10T 403/32262; Y10T 403/32286; Y10T 403/32377; Y10T 403/342
USPC ..... 52/81.3, 653.2, 655.1, 704; 135/120.3, 135/147, 153, 154, 909; 403/52, 61, 64, 65, 403/169, 170, 175, 180, 385; 411/104
See application file for complete search history.

(56) References Cited

U.S. PATENT DOCUMENTS

| | | | | | |
|---|---|---|---|---|---|
| 2,044,659 | A * | 6/1936 | Adams | 135/99 |
| 2,151,908 | A * | 3/1939 | Gottlieb | 135/136 |
| 2,757,677 | A * | 8/1956 | Denn | 135/160 |
| 3,213,273 | A * | 10/1965 | Zagel | 362/431 |
| 4,758,111 | A * | 7/1988 | Vitta | 403/176 |
| 5,536,097 | A * | 7/1996 | Hazan | 403/171 |
| 6,892,503 | B1 * | 5/2005 | Kang | 52/653.2 |
| 2008/0277640 | A1 * | 11/2008 | Striebel et al. | 256/67 |
| 2009/0056782 | A1 * | 3/2009 | Jones | 135/151 |
| 2014/0199112 | A1 * | 7/2014 | Milner et al. | 403/72 |

* cited by examiner

*Primary Examiner* — Robert Canfield
(74) *Attorney, Agent, or Firm* — Robert E. Howard

(57) ABSTRACT

An adjustable frame connector comprising at least two fixed tubular legs and an adjustable tubular leg. The fixed legs have inner ends that are joined together, and have longitudinal axes that intersect each other at right angles. The adjustable leg has an inner end that is pivotally attached to the fixed legs at their juncture so that the adjustable leg can be moved from a first position wherein its longitudinal axis is coaxial with the longitudinal axis of a first one of the fixed tubular legs to a second position wherein its longitudinal axis is at a right angle to the longitudinal axis of the first one of the fixed tubular legs. Releasable locking means allows the adjustable leg to be releasably locked into position relative to the first one of the fixed tubular legs at any selected location along the ninety degree arc between its first and second positions.

17 Claims, 3 Drawing Sheets

ADJUSTABLE FRAME CONNECTOR

BACKGROUND OF THE INVENTION

The present invention relates to an adjustable frame connector for erecting the frame of a temporary structure, such as a tent.

When temporary structures, such as tents, are erected, a frame is first assembled from a plurality of tubular poles joined together by inserting the ends of the poles into tubular pole connectors and locking them in place with set screws. The connectors typically have three or four tubular legs or sleeves adapted to receive the ends of the tubular poles, ail of the legs being at a fixed angle to each other. Vertical tubular poles (leg poles) are removably attached to a first type connector located at their upper ends, the first type connectors also being removably attached to horizontal tubular poles (eave poles) to form the side walls and end walls. Upwardly angled tubular poles (rafter poles) are removably attached at their lower ends to the first type connectors joining the tubular leg poles and tubular eave poles, and removably attached at their upper ends to a second type connector removably joining the tubular horizontal poles (ridge poles) that form the ridge.

Since the legs of such prior art connectors are at a fixed angle to each other, a large number of connectors of differing configurations must be inventoried by those renting or selling tents to accommodate different tent configurations and sizes.

SUMMARY OF THE INVENTION

It is an object of the present invention to provide an adjustable frame connector for erecting the frame of a temporary structure, such as a tent.

The present invention relates to adjustable frame connectors used in erecting rectangularly shaped temporary structures, such as tents, that requires only two basic configurations.

The first adjustable frame connector is adapted to be used at the ends of a frame structure. The first adjustable connector has three tabular legs adapted to receive the ends of three tubular tent poles. The three tubular legs meet at a common juncture at their inner ends. The first and second tubular legs (the "fixed legs") are at feed tight angles to each other, and form an L-shaped member. The third tubular leg (the "adjustable leg") has a common longitudinal axis with one of the fixed legs when it is positioned within the same plane as the first and second fixed legs, the third tabular leg being pivotal around a ninety degree are to allow multiple three-legged configurations to be farmed. The adjustable leg can be locked into place at a selected position along the ninety degree arc by merely twisting the leg clockwise about its longitudinal axis, and unlocked by twisting the leg counter-clockwise. Eyebolts are located adjacent the ends of all three legs to allow tubular frame poles inserted therein to be secured in place.

The second basic adjustable frame connector configuration, is adapted to be used at mid-portions of a frame structure. The second adjustable connector has four tubular legs adapted to receive four tubular tent poles. The second and third tubular legs have a fixed common, longitudinal axis, i.e., are coaxial, and are preferably formed from a single tubular member. A first tubular leg is welded or otherwise affixed to a mid-portion of the tubular member forming the second and third coaxial legs, its extended longitudinal axis being at right angles to the coaxial longitudinal axis of the second and third tabular legs. The first, second, and third legs are "fixed legs" and form a T-shaped member. A fourth tubular leg is adjustably mounted to the tubular member forming the second and third fixed legs at a location opposite the first fixed tubular leg, and cat) be pivoted along a ninety degree arc from a first position where its extended longitudinal axis is common to the extended longitudinal axis of the first fixed tubular leg to a position where its extended longitudinal axis is perpendicular to the extended longitudinal axis of the first feed tubular leg. The fourth tubular leg (the "adjustable leg") can be locked into place at any selected position along the ninety degree arc by merely twisting the adjustable leg clockwise about its longitudinal axis, and unlocked by twisting the adjustable leg counter-clockwise. Eyebolts are located adjacent the ends of all four legs to allow tabular frame poles inserted therein to be secured in place.

The adjustable tubular legs of the two connector configurations, i.e., the third leg of the first configuration and the fourth leg of the second configuration, have identical configurations. Each adjustable tubular leg member includes a hollow cylinder or sleeve having a dosed inner end through which passes and extends outwardly a fixed threaded fastening member (e.g., a bolt).

In the first connector configuration a cylindrical lock member is located at the inner end of the second of the two fixed tubular legs and is configured to rotate therein. The cylindrical lock member has a threaded opening attested to receive the threaded fastening member of the adjustable tubular leg. A ninety degree slot formed at the inner end of the second of the two fixed tubular legs receives the threaded fastening member of the adjustable tubular leg there through and into releasable locking engagement with the cylindrical lock member, and allows the adjustable tubular leg to be rotated through a ninety degree are.

In the second connector configuration a cylindrical lock member is located at the mid-portion of the two tubular legs formed from a single hollow cylinder and is configured to rotate therein. The cylindrical lock member has a female threaded opening adapted to receive the male threaded fastening member of the adjustable tubular leg. A ninety degree slot formed at the mid-portion of the two fixed tubular legs formed from a single hollow cylinder receives the threaded fastening member through and into releasable locking engagement with the cylindrical lock member, and allows the adjustable leg to be rotated through a ninety degree arc.

BRIEF DESCRIPTION OF TOE DRAWINGS

FIG. 1 is a perspective stick figure of a stylized tent frame showing the locations of the connectors of the present invention;

FIG. 2 A is a side view of the first connector configuration,

FIG. 2 B is a top view of the first connector configuration,

FIG. 3 A is a side view of the second connector configuration;

FIG. 3 B is a top view of the second connector configuration;

DESCRIPTION OF PREFERRED EMBODIMENTS

Figure 1:
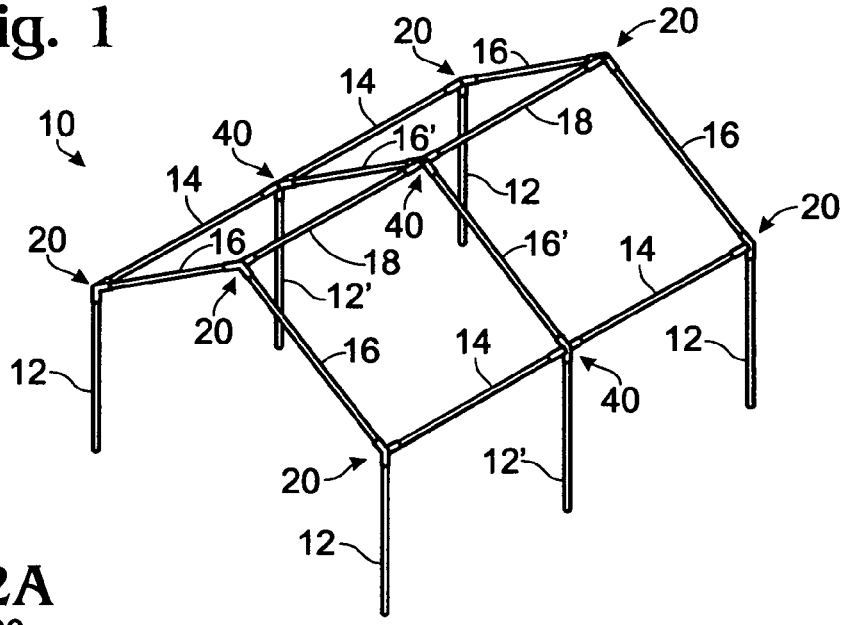

The frame 10 of a temporary structure, such as a tent, can be assembled as shown in FIG. 1. FIG. 1 is merely an illustration of a configuration of a simple frame structure, and is presented solely for the purpose of showing the locations of the connectors of the invention.

The frame 10 is comprised of a plurality of tubular poles, and includes vertically disposed corner leg poles 12, vertically disposed middle leg poles 12', horizontally disposed eave poles 14, angled end rafter poles 16, angled middle rafter poles 16', and horizontal disposed ridge poles 18. The poles are of a size and material commonly used for such framing.

The upper ends of each of the corner leg poles 12 are removably attached to a first connector configuration 20, the first connector configuration 20 also being removably attached to the outer ends of eave poles 14. Upwardly angled end rafter poles 16 are removably attached at their lower ends to the first type connector configuration 20, and removably attached at their upper ends to the first type connector configuration 20 which is also removably attached to the outer ends of tubular ridge poles 18.

The upper ends of each of the middle leg poles 12' are removably attached to a second connector configuration 40, the second connector configuration 40 also befog removably attached to the inner ends of cave poles 14. Upwardly angled middle rafter poles 16' are removably attached at their lower ends to the second type connectors 40 and removably attached at their upper ends to a second type connector 40 which removably join adjacent inner ends of tubular ridge poles 18.

Figure 2A:
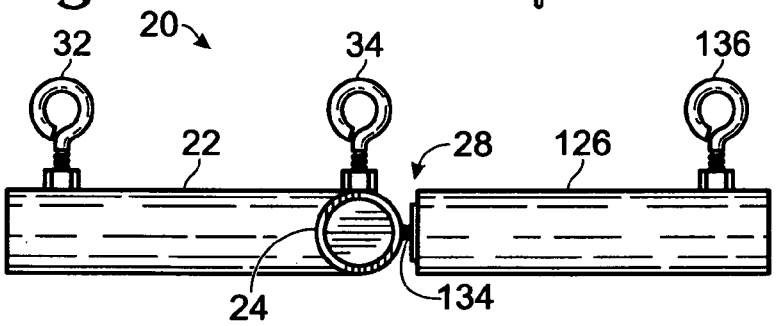
Figure 2B:
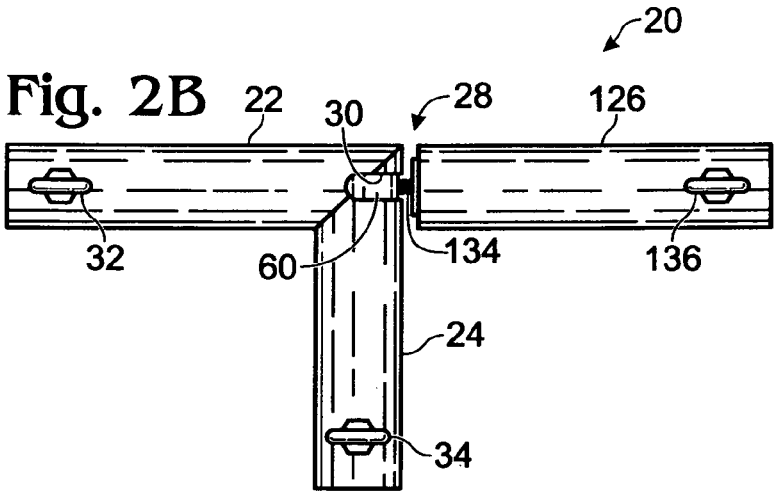
Figure 5A:
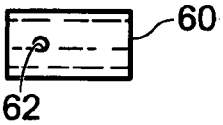
FIG. 5A is a side view of the locking cylinder used with the first connector configuration.
Figure 5B:
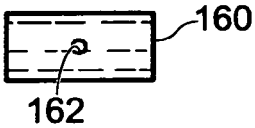
FIG. 5B is a side view of the locking cylinder used with the second connector configuration.
Figure 6:
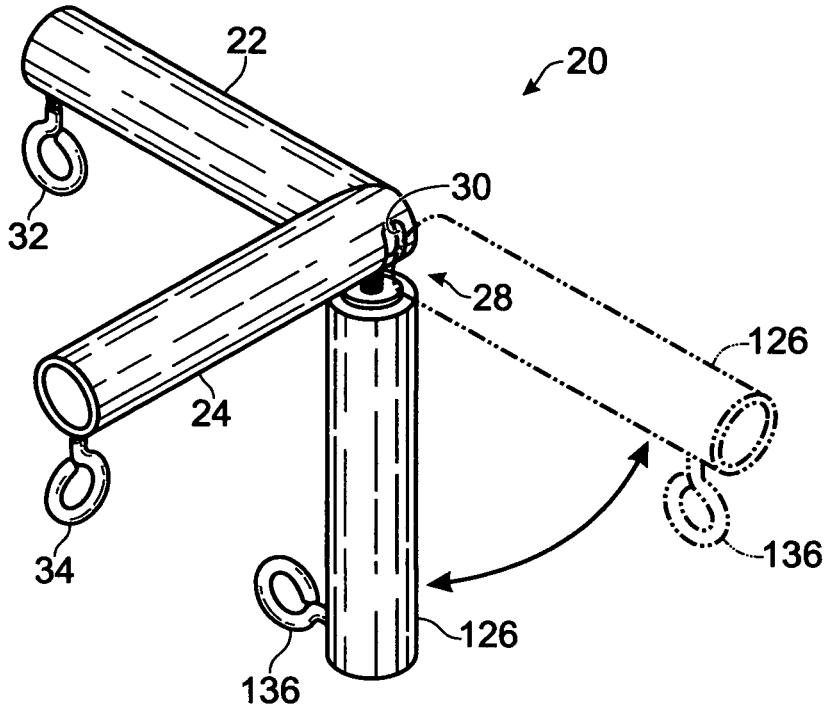
FIG. 6 is a perspective view of the first connector configuration showing the adjustable tubular leg in its two extreme positions along its ninety degree pivot arc.

The first adjustable frame connector 20 is adapted to be used at the ends of frame structure 10. The first adjustable connector 20 has three tubular legs 22, 24, and 126 adapted to receive the ends of three tubular tent poles. The three tubular legs 22, 24, and 126 meet at a common juncture 28 at their inner ends, as shown in FIGS. 2A, 2B, and 6. First and second tabular legs (the "fixed legs") 22 and 24 are attached to each other at their inner ends, meeting at a fixed right angle to each other and forming a fixed L-shaped member, as seen in FIGS. 2B and 6. The third tubular leg (the "adjustable leg") 126 has a common extended longitudinal axis with first tubular fixed leg 22 when it is positioned within the same plane as first and second fixed tubular legs 22 and 24, the adjustable tubular leg 126 being pivotal along a ninety degree are by virtue of ninety degree slot 30 formed to second fixed tubular leg 24, and the releasable locking means to be described, to thereby allow multiple three-legged configurations to be formed. The adjustable leg 126 can be locked into place at any selected position along its ninety degree pivot, arc by merely twisting it clockwise about its longitudinal axis, and unlocked by twisting the leg counter-clockwise, as will be discussed further. Pole securing members, such as eyebolts 32, 34, and 136, are located adjacent the ends of legs 22, 23, and 126, respectively, and allow pole members inserted into the tubular legs to be secured.

Figure 3A:
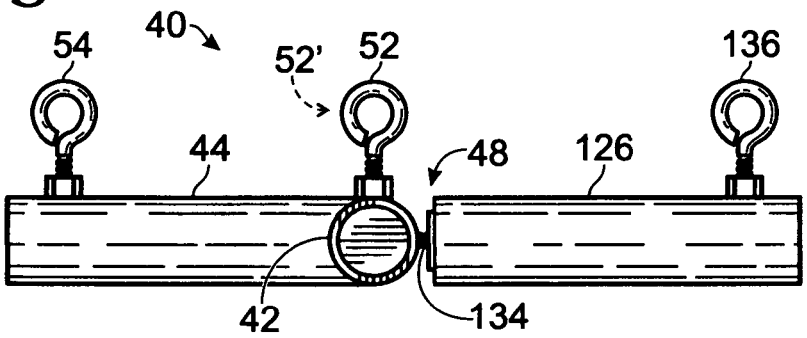
Figure 3B:
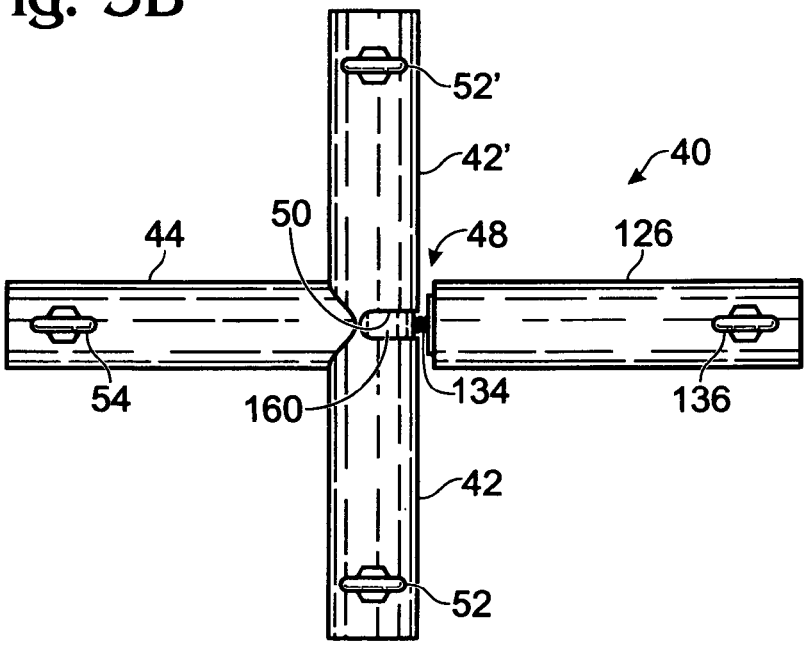
Figure 7:
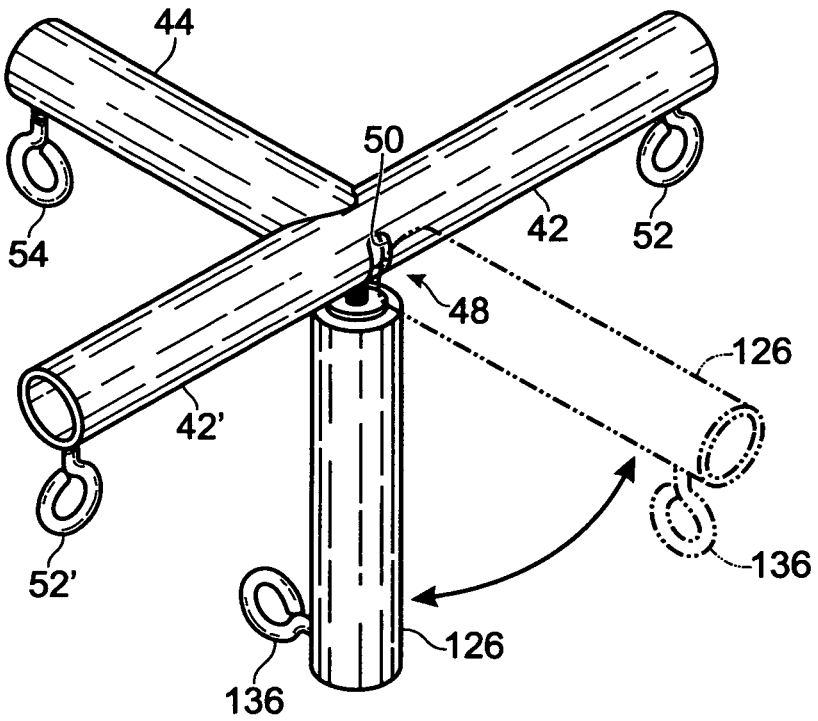
FIG. 7 is a perspective view of the second connector configuration showing the adjustable tubular leg in its two extreme positions along its ninety degree pivot arc.

The second adjustable frame connector configuration 40 is adapted to be used at mid-portions of a frame structure. The second adjustable connector configuration 40 has four tubular legs 42, 42', 44, and 126 adapted to receive four tubular tent poles. Second and third fixed tubular legs 42 and 42' have a common longitudinal axis, i.e., are coaxial, and are preferably formed from a single tubular member. First fixed tubular leg 44 is attached (e.g., by welding) to a mid-portion of the tubular member forming second and third fixed tubular legs 42, 42'. The extended longitudinal axis of first fixed tubular leg 44 is at right angles to the extended longitudinal axis of the tubular member forming second and third tubular legs 42, 42'. The first, second and third tubular legs 44, 42, and 42' are "fixed legs" meeting at a juncture 48 to form a fixed T-shaped member, as shown in FIGS. 3B and 7. The fourth tubular leg 126 is adjustably mounted to the tubular member forming the second and third fixed tubular legs 42, 42' at a location opposite the first, fixed tubular leg 44, and can be pivoted through a ninety degree arc from a first position where its extended longitudinal axis is common to the extended longitudinal, axis of first fixed tabular leg 44 to a position where its extended longitudinal axis is perpendicular to the extended longitudinal axis of fast fixed tabular leg 44 by virtue of ninety degree slot 50 and the releasable locking means to be described. The fourth tubular leg (the "adjustable leg") 126 can be locked into place at any selected position along its ninety degree pivot arc by merely twisting it clockwise about its longitudinal axis, and unlocked by twisting it counter-clockwise, as will be discussed further. Pole securing members, such as eyeballs 52, 52', 54, and 136 are located adjacent the ends of legs 42, 42', 44 and 126, respectively, and allow pole members inserted into the tubular legs to be secured.

Figure 4:
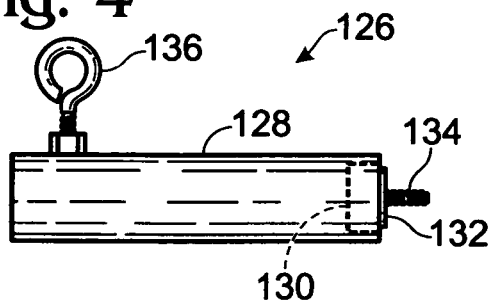
FIG. 4 is a side view of the adjustable tubular leg used with either the first or connector configurations.

The adjustable tubular legs 126 of the two connector configurations 20 and 40 have an identical configuration, as shown in FIG. 4. Each adjustable tubular leg member 126 includes a hollow cylinder or sleeve 128 having a closed inner end 130 and attached outer washer 132 through which passes and extends therefrom a feed male threaded fastening member 134 (e.g., a bolt). A pole securing member, such as eyebolt 136 is threadably attached to the cylinder 328 adjacent its open outer end and allows a tent pole placed within the cylinder to be locked in place.

The inner and outer diameters and lengths of fixed tubular legs 22, 24, fixed tubular legs 42, 42', 44, and adjustable tubular leg 125 are preferably substantially identical, and configured to snugly receive tent poles during erection of a temporary structure.

The releasable locking means in the first connector configuration 20 includes a cylindrical lock member 60 located within second fixed tubular leg 24 adjacent its inner end, and is configured to rotate therein about its common longitudinal axis with second fixed tubular leg 24. The cylindrical lock member 60 has a female threaded opening 62 located adjacent its inner end and adapted to receive the male threaded fastening member 134 of the adjustable tubular leg 126. The ninety degree slot 30 formed adjacent the inner end of second fixed tubular leg 24 receives the threaded fastening member 134 there through and into releasable locking engagement with cylindrical lock member 60 via female threaded opening 62. When adjustable tubular leg 126 is rotated clockwise about its longitudinal axis to its fullest extent, either manually or with the aid of a wrench, leg 126 is locked in place. Leg 126 can be unlocked by rotating leg 126 in a counterclockwise direction about its longitudinal axis until leg 126 is loosened to an unlocked position, either manually or with the aid of a wrench, and in its unlocked position tubular leg 126 can be rotated to any desired position through the ninety degree arc of she slot 30.

In the second connector configuration a cylindrical lock member 160 is located at the mid-portion of the tubular member forming fixed tubular legs 42, 42', and is adapted to rotate therein about its common longitudinal axis with the tubular member forming fixed tubular legs 42, 42'. The cylindrical lock member 160 has a female threaded opening 162 located at its raid-portion and adapted to receive the male threaded fastening member 134 of the adjustable tubular leg 126. The ninety degree slot 50 formed at the mid-portion of the tubular member forming second and third fixed tubular legs 42, 42' receives the threaded fastening member 134 there through and into releasable locking engagement with cylindrical lock member 60 via female threaded opening 62. When adjustable tubular leg 126 is rotated clockwise about its longitudinal, axis to its fullest extent, either manually or with the aid of a wrench, adjustable leg 126 is locked in place. Adjustable leg 126 can be unlocked by rotating leg 126 in a counterclockwise direction about its longitudinal axis until leg 126 is loosened to an unlocked position, either manually or with the aid of a wrench, and in its unlocked position tubular leg 126 can be rotated to any desired position through the ninety degree arc of the slot 50.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An adjustable frame connector comprising:

at least first and second fixed tubular legs, each of said first and second fixed tubular legs having a longitudinal axis and each of said first and second fixed tubular legs having inner and outer ends, said inner ends of said fixed legs being joined together at the juncture of their inner ends, said fixed tubular legs, the longitudinal axis of said first fixed tubular leg intersecting with the longitudinal axis of said second fixed tubular leg at said juncture at substantially right angles;

an adjustable tubular leg having inner and outer ends, said adjustable leg having a longitudinal axis, said inner end of said adjustable leg being pivotally attached to said fixed tubular legs at their juncture in a manner such that said adjustable leg can be rotated along a ninety degree arc from a first position where its longitudinal axis is substantially coaxial with the longitudinal axis of said first fixed tubular leg to a second position where its longitudinal axis is substantially at a right angle to said longitudinal axis of said first fixed tubular leg; and releasable locking means configured to allow said adjustable leg to be releasably locked into position relative to said fixed tubular legs at any selected location along said ninety degree arc.

2. The adjustable frame connector of claim 1 wherein said releasable locking means includes a male threaded fastening member extending outwardly from the inner end of said adjustable tubular leg along its longitudinal axis, a ninety degree slot formed in the wall of said second fixed tubular leg adjacent its inner end, said slot passing through the longitudinal axis of said first fixed tubular leg, a cylindrical lock member positioned within said second fixed tubular leg and configured to rotate therein, said cylindrical lock member having a female threaded opening therein located in alignment with said slot and configured to receive said male threaded fastening member in releasably locking engagement.

3. The adjustable frame connector of claim 2 wherein said male threaded fastening member is surrounded by a washer located adjacent said inner end of said adjustable tubular leg.

4. The adjustable frame connector of claim 1 wherein each of said fixed and adjustable tubular legs have pole securing members located adjacent their outer ends.

5. The adjustable frame connector of claim 4 wherein said pole securing members are eyebolts.

6. The adjustable frame connector of claim 1 wherein said fixed and adjustable tubular legs have inner diameters that are substantially identical and configured to receive tent poles.

7. The adjustable frame connector of claim 1 including a third fixed tubular leg, said third fixed tubular leg having a longitudinal axis that is coaxial with said longitudinal axis of said second fixed tubular leg.

8. An adjustable frame connector comprising:

first and second fixed tubular legs having inner and outer ends, said inner ends of said first and second fixed legs being joined together at the juncture of their inner ends, said first and second fixed tubular legs each having a longitudinal axis, the longitudinal axis of said first fixed tubular leg intersecting with the longitudinal axis of said second fixed tubular leg at said juncture at substantially right angles;

an adjustable tubular leg having inner and outer ends, said adjustable leg having a longitudinal axis, said inner end of said adjustable leg being pivotally attached to said second fixed tubular leg adjacent its inner end in a manner such that said adjustable leg can be rotated along a ninety degree arc from a first position where its longitudinal axis is substantially coaxial with the longitudinal axis of said first fixed tubular leg to a second position where its longitudinal axis is substantially at a right angle to said longitudinal axis of said first fixed tubular leg; and releasable locking means configured to allow said adjustable leg to be releasably locked into position relative to said fixed tubular legs at any selected location along said ninety degree arc.

9. The adjustable frame connector of claim 8 wherein said releasable locking means includes a male threaded fastening member extending outwardly from the inner end of said adjustable tubular leg along its longitudinal axis, a ninety degree slot formed in the wall of said second fixed tubular leg adjacent its inner end, said slot passing through the longitudinal axis of said first fixed tubular leg, a cylindrical lock member positioned within said second fixed tubular leg and configured to rotate therein, said cylindrical lock member having a female threaded opening therein located in alignment with said slot and configured to receive said male threaded fastening member in releasably locking engagement.

10. The adjustable frame connector of claim 9 wherein said male threaded fastening member is surrounded by a washer located adjacent said inner end of said adjustable tubular leg.

11. The adjustable frame connector of claim 8 wherein each of said fixed and adjustable tubular legs have pole securing eyebolts located adjacent their outer ends.

12. The adjustable frame connector of claim 8 wherein said fixed and adjustable tubular legs have inner diameters that are substantially identical and configured to receive tent poles.

13. An adjustable frame connector comprising:

first, second, and third fixed tubular legs, said first fixed tubular leg having inner and outer ends, said second and third fixed tubular legs being formed from a single tubular member, said inner end of said first fixed leg being joined to said tubular member forming said second and third fixed tubular legs at its mid-portion, said fixed tubular legs each having a longitudinal axis, the longitudinal axes of said second and third fixed tubular legs being coaxial, the longitudinal axis of said first fixed tubular leg intersecting the coaxial longitudinal axis of said second and third fixed tubular legs substantially at said mid-portion of said tubular member forming said second and third fixed tubular legs at substantially right angles;

an adjustable tubular leg having inner and outer ends, said adjustable leg having a longitudinal axis, said inner end of said adjustable leg being pivotally attached to said tubular member forming said second and third fixed tubular legs at its mid-portion in a manner such that said adjustable leg can be rotated along a ninety degree arc from a first position where its longitudinal axis is substantially coaxial with the longitudinal axis of said first fixed tubular leg to a second position where its longitudinal axis is substantially at a right angle to said longitudinal axis of said first fixed tubular leg; and releasable locking means configured to allow said adjustable leg to be releasably locked into position relative to said fixed tubular legs at any selected location along said ninety degree arc.

14. The adjustable frame connector of claim 13 wherein said releasable locking means includes a male threaded fastening member extending outwardly from the inner end of said adjustable tubular leg along its longitudinal axis, a ninety degree slot formed in the wall of said tubular member forming said second and third fixed tubular legs at its mid-portion, said slot passing through the longitudinal axis of said first fixed tubular leg, a cylindrical lock member positioned within said tubular member forming said second and third fixed tubular legs and configured to rotate therein, said cylindrical lock member having a female threaded opening therein located in alignment with said slot and configured to receive said male threaded fastening member in releasably locking engagement.

15. The adjustable frame connector of claim 14 wherein said male threaded fastening member is surrounded by a washer located adjacent said inner end of said adjustable tubular leg.

16. The adjustable frame connector of claim 13 wherein each of said fixed and tubular legs have pole securing eyebolts located adjacent their outer ends.

17. The adjustable frame connector of claim 13 wherein said fixed and adjustable tubular legs have inner diameters that are substantially identical and configured to receive tent poles.

* * * * *